US011723464B2

(12) United States Patent
Hu

(10) Patent No.: US 11,723,464 B2
(45) Date of Patent: Aug. 15, 2023

(54) PIVOTING MESH SHELF LOCKING CLAMP

(71) Applicant: Hebei Minmetals Co., Ltd., Shijiazhuang (CN)

(72) Inventor: Kebiao Hu, Shijiazhuang (CN)

(73) Assignee: HEBEI MINMETALS CO., LTD, Shijiazhuang (CN)

( * ) Notice: Subject to any disclaimer, the term of this patent is extended or adjusted under 35 U.S.C. 154(b) by 0 days.

(21) Appl. No.: 17/524,006

(22) Filed: Nov. 11, 2021

(65) Prior Publication Data

US 2022/0151384 A1 May 19, 2022

Related U.S. Application Data

(60) Provisional application No. 63/115,313, filed on Nov. 18, 2020.

(51) Int. Cl.

| | |
|---|---|
| ***A47B 96/00*** | (2006.01) |
| ***A47B 96/02*** | (2006.01) |
| ***A47B 96/07*** | (2006.01) |
| ***A47B 57/54*** | (2006.01) |

(52) U.S. Cl.
CPC ..... *A47B 96/021* (2013.01); *A47B 57/54* (2013.01); *A47B 96/07* (2013.01)

(58) Field of Classification Search
None
See application file for complete search history.

(56) References Cited

U.S. PATENT DOCUMENTS

| | | | | |
|---|---|---|---|---|
| 3,463,433 | A * | 8/1969 | Coe | A47B 57/42 248/242 |
| 4,722,648 | A | 2/1988 | Camelleri | |
| 5,641,083 | A * | 6/1997 | Metcalf | A47B 57/045 108/1 |
| 6,123,303 | A | 9/2000 | Huang | |
| 6,402,108 | B1 | 6/2002 | Remmers | |
| 6,641,098 | B1 * | 11/2003 | Proffitt | A47B 57/42 248/242 |
| 7,055,786 | B2 | 6/2006 | Garassino | |
| 7,188,740 | B2 | 3/2007 | Marchetta | |
| 7,240,803 | B2 | 7/2007 | Stitchick | |
| 7,392,911 | B2 | 7/2008 | Stitchick | |
| D589,780 | S | 4/2009 | Fernandez | |
| 7,640,244 | B1 | 6/2009 | Gregory | |

(Continued)

FOREIGN PATENT DOCUMENTS

WO WO-9428777 A1 * 12/1994 ..... A47B 57/40

*Primary Examiner* — Steven M Marsh
(74) *Attorney, Agent, or Firm* — Parker Poe Adams a& Bernstein, LLP

(57) ABSTRACT

A mesh shelf system comprises a bracket mount, a bracket, a mesh shelf, and a shelf locking clamp. The bracket mount defines a plurality of mount apertures. The bracket is attached to the bracket mount by interfitting with the mount apertures. The mesh shelf is carried by the bracket and includes a crossbar residing proximate to the bracket mount. The shelf locking clamp includes first and second convexities that are disposed in apertures in the bracket, and the shelf locking clamp is rotatable between a first position away from the crossbar and a second position in which the shelf locking clamp resides proximate to the first crossbar. In the second position, the shelf locking clamp is attachable to the bracket mount.

13 Claims, 8 Drawing Sheets

(56) References Cited

U.S. PATENT DOCUMENTS

| | | | | |
|---|---|---|---|---|
| 10,021,972 | B1 * | 7/2018 | Robinson | A47B 57/30 |
| 2005/0011568 | A1 | 1/2005 | Kagenow | |
| 2005/0284828 | A1 | 12/2005 | Remmers | |
| 2006/0175495 | A1 * | 8/2006 | Gregory | A47B 96/028<br>248/250 |
| 2008/0067139 | A1 * | 3/2008 | Claypool | A47B 96/061<br>211/205 |
| 2011/0192948 | A1 | 8/2011 | Chen | |
| 2016/0320034 | A1 | 11/2016 | Wessel | |

* cited by examiner

PIVOTING MESH SHELF LOCKING CLAMP

CROSS REFERENCE TO RELATED APPLICATIONS

This application claims the benefit of priority of U.S. Provisional Application Ser. No. 63/115,313, filed on Nov. 18, 2020, which is incorporated herein in its entirety.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIALS SUBMITTED ON A COMPACT DISC OR AS A TEXT FILE VIA THE OFFICE ELECTRONIC FILING SYSTEM

Not applicable.

STATEMENT REGARDING PRIOR DISCLOSURES BY THE INVENTOR OR A JOINT INVENTOR

Not applicable.

BACKGROUND OF THE INVENTION

Field of the Invention

The present invention relates to a clamp for locking a shelf to a shelving system and, more particularly, to a clamp within a mesh shelf system pivotable between an unlocked position and a locked position.

Description of the Related Art

Mesh shelving systems are easy to assemble, versatile, and relatively inexpensive. They may be used in closets, garages, offices, playrooms, and other locations in which shelving might provide organization, storage, and ease of access.

A typical mesh shelving system might include a bracket mounted to, for example, a bracket mount. A mesh shelf may then be laid upon the bracket, creating a horizontal shelf. In such an example, the mesh shelf would be held to the bracket by gravity.

In some applications, it may be desirable to affix the shelf to the bracket, such as by locking the shelf to the bracket. Restated, it may be desirable for gravity alone not to hold the shelf to the bracket, but instead that the shelf be held to the bracket by a mechanical feature. And in those applications, it might be desirable that what can be locked could also be unlocked, such that the shelving system could be disassembled or to move the shelf from one vertical height to another.

Unfortunately, the known systems for locking a mesh shelf to a bracket are not easy to use, requiring the user to manipulate difficult-to-reach features to slide a mechanism from one location to another, and/or being complicated to use, and/or being cumbersome to manufacture, and/or being unreliable in securing a shelf to a bracket, and/or being fragile in use.

In view of the foregoing, it would be desirable to provide a mesh shelf lock that would provide for reliable and effective locking of a shelf to a bracket, yet that would be easy and sturdy to use, would allow for both locking and subsequent unlocking and still subsequent relocking, and would provide for simplicity in manufacturing.

The present invention relates to an improvement upon the known systems and methods mesh shelf locking, and provides distinct advantages over the conventional systems and methods.

BRIEF SUMMARY OF THE INVENTION

A pivoting mesh shelf locking clamp is provided. As revealed in the following description and the figures herein, this invention discovers a simple, effective, and reliable clamp that pivots to lock or unlock a mesh shelf to a shelving system.

In accordance with certain aspects of certain embodiments of the present technology, a pivotable mesh shelf locking clamp may include a body, a first convexity, and a first arm. The body may have a first end and an opposite second end. The body may further have a first convexity extending from the body proximate to the first end and a first arm extending from the body proximate to the second end. The body may define a lower profile between the first convexity and the first arm. The clamp may be rotatable about the first convexity relative to a shelf bracket, between a first unlocked position and a second locked position. Additionally and/or alternatively, in various embodiments one or more of the following aspects may also be included:

(a) a second convexity, the second convexity extending from the body proximate to the first end, the first convexity and the second convexity extending oppositely from each other;

(b) a second arm, the second arm extending from the body proximate to the second end;

(c) a second arm, the second arm extending from the body proximate to the second end, the first and second arms being resiliently bendable;

(d) a second arm, the second arm extending from the body, and each of the first arm and the second arm terminating in a hook;

(e) a second arm, the second arm extending from the body proximate to the second end, the first and second arms being resiliently bendable and parallel to each other; and/or (f) a second convexity extending from the body proximate to the first end, the first and second convexities defining an axis of rotation between them, the mesh shelf locking clamp further including a second arm extending from the body proximate to the second end, the first and second arms being resiliently bendable in a plane parallel to the axis of rotation; and/or (g) a method of locking a mesh shelf, comprising the steps of:

providing a bracket mount;

attaching a bracket to the bracket mount;

providing the mesh shelf locking clamp as described in Paragraph 0015;

attaching the mesh shelf locking clamp to the bracket;

positioning the mesh shelf locking clamp in the first unlocked position;

placing a mesh shelf with a rear crossbar upon the bracket with the rear crossbar proximate to the bracket mount; and rotating the mesh shelf locking clamp to the second locked position.

In accordance with additional aspects of other embodiments of the present technology, a mesh shelf system may include a bracket mount, a bracket, a mesh shelf, and a mesh shelf locking clamp. The bracket may be attached to the bracket mount. The mesh shelf may be carried by the bracket and may include a first crossbar residing proximate to the bracket mount. The mesh shelf locking clamp may be attached to the bracket and be rotatable relative to the bracket between a first position away from the first crossbar and a second position in which the mesh shelf locking clamp covers a portion of the first crossbar. Additionally and/or alternatively, in various embodiments one or more of the following aspects may also be included:

(a) the mesh shelf locking clamp may be selectively detachable from the bracket;

(b) the mesh shelf locking clamp may be selectively attachable and detachable from the bracket mount;

(c) the mesh shelf locking clamp may define an axis of rotation and the mesh shelf locking clamp includes first and second arms, the first and second arms being resilient in a plane parallel to the axis of rotation;

(d) a second crossbar residing proximate to the bracket mount, the mesh shelf locking clamp covering a portion of the second crossbar when the mesh shelf locking clamp is in the second position; and/or (e) the bracket mount defines plural mount apertures, the mesh shelf locking clamp defines an axis of rotation, the mesh shelf locking clamp includes first and second arms, the first and second arms are resilient in a plane parallel to the axis of rotation, and each of the first and second arms terminate in hooks, the hooks being interfitted into separate mount apertures when the mesh shelf locking clamp is in the second position.

In accordance with still further aspects of other embodiments of the present technology, a mesh shelf system may include a bracket mount, a bracket, a first mesh shelf, and a mesh shelf locking clamp. The bracket mount may define a plurality of mount apertures. The bracket may be attached to the bracket mount by interfitting with at least one mount aperture, and the bracket may define first and second bracket apertures. The first mesh shelf may be carried by the bracket and include a first crossbar residing proximate to the bracket mount. The mesh shelf locking clamp may include first and second convexities, the first convexity being disposed in the first bracket aperture and the second convexity being disposed in the second bracket aperture, the first and second convexities defining between them an axis of rotation. The mesh shelf locking clamp may be rotatable about the axis of rotation between a first position away from the first crossbar and a second position in which the mesh shelf locking clamp resides proximate to a portion of the first crossbar. The mesh shelf locking clamp may be attachable to the bracket mount when in the second position. Additionally and/or alternatively, in various embodiments one or more of the following aspects may also be included:

(a) the mesh shelf locking clamp is detachable from the bracket mount;

(b) the bracket includes a slot that is located proximate to the bracket mount and the first crossbar resides in the slot;

(c) the mesh shelf locking clamp includes an arm and the arm is inserted into a mount aperture;

(d) the mesh shelf locking clamp includes first and second arms, which are each insertable into separate mount apertures; and/or (e) a second mesh shelf, the second mesh shelf being carried by the bracket, the second mesh shelf including a second crossbar residing proximate to the bracket mount, the first and second mesh shelves nested with each other, and the mesh shelf locking clamp in the second position residing proximate to a portion of the second crossbar.

Additional advantages of the invention will be set forth in part in the description that follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

The purpose of the Abstract hereinabove is to enable the United States Patent and Trademark Office, and the public generally, to determine quickly from a cursory inspection the nature of the technical disclosure. The Abstract is not provided for interpreting the scope of the claims herein, nor to define the invention or the application, nor to be limiting in any way as to the scope of the invention.

BRIEF DESCRIPTION OF THE DRAWINGS

The details of the present invention, as to both its structure and its operation, can be understood with reference to the accompanying drawings, in which.

Figure 1:
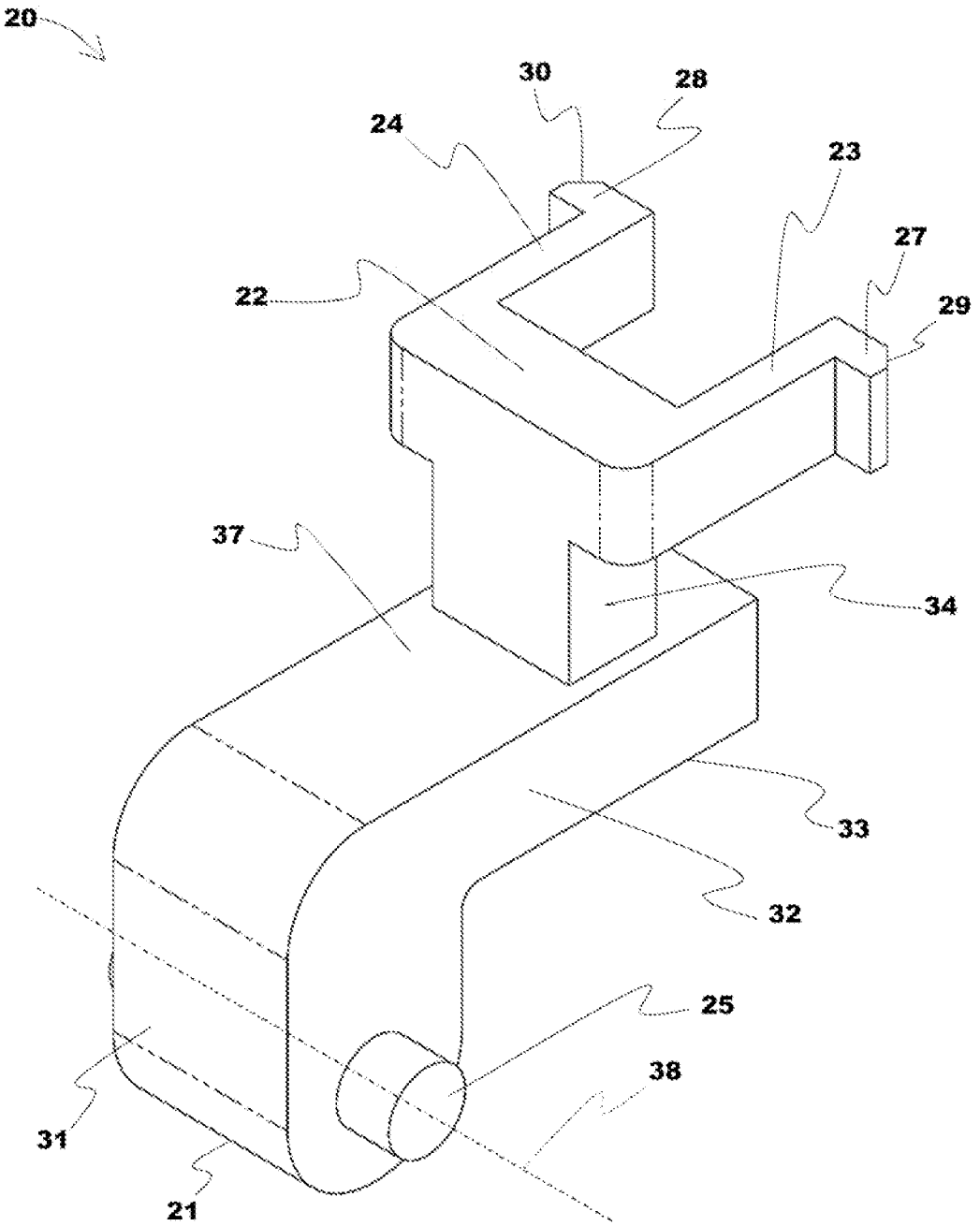
FIG. 1 is a perspective view of a pivoting mesh shelf locking clamp according to an embodiment of the present invention.

It should be noted that the drawings discussed above and below are not to scale in all instances, but may have exaggerated dimensions in some respect to illustrate the principles of the invention.

DETAILED DESCRIPTION OF REPRESENTATIVE EMBODIMENTS

Reference will now be made in detail to the presently preferred embodiments of the invention, one or more examples of which are illustrated in the drawings. Each example is provided by way of explanation of the invention, and is not meant as a limitation of the invention. For example, features illustrated or described as part of one embodiment may be used with a second embodiment to yield a third embodiment. It is intended that the present application include such modifications and variations as come within the scope and spirit of the invention. Repeat use of reference characters throughout the present specification and appended drawings is intended to represent the same or analogous features or elements of the invention.

Before any embodiments of the invention are explained in detail, it is to be understood that the invention is not limited in its application to the details of construction or to the arrangement of components set forth in the following description or illustrated in the drawings. The invention is capable of other embodiments and of being practiced or of being carried out in various ways.

It is to be further understood that the phraseology used herein is for the purpose of description and should not be regarded as limiting. The use of formatives of the words "include," "comprise," and "have" is meant to encompass the items listed thereafter and equivalents thereof, as well as additional items.

Unless specified or limited otherwise, the terms "connected" and "carried by" are used broadly and encompass direct and indirect mountings, connections, supports, or couplings. Further, such phraseology is not limited to physical or mechanical connections or couplings.

As used herein, the term "horizontal" refers to an orientation parallel to the horizon, and term "vertical" refers to an orientation perpendicular to the horizon.

As used herein, the term "back" refers to a position toward the bracket mount, and the term "front" refers to a position away from the bracket mount and toward a user of the shelf system. The term "forward" refers to an orientation or position toward the front, and the term "rearward" refers to an orientation or position opposite "forward" and toward the back.

As used herein, the terms "above" and "below" are with gravitational reference. Thus, a component is "above" another if, when the present technology is in regular use, that component is gravitationally higher than the other.

A pivoting mesh shelf locking clamp 20 is disclosed. The clamp 20 has a body 37 with a first end 21 and a second end 22 and a lower profile 33 residing between the first end 21 and the second end 22.

The clamp 20 may include a first convexity 25 extending from the body 37 proximate the first end 21. The first convexity 25 may be a bump, dimple, node, prominence, protuberance, or other like projection extending outboard of the body 37. The first convexity 25 may define an axis of rotation 38 of the clamp 20.

In some embodiments, the clamp 20 may also include a second convexity 26 that may or may not shaped like the first convexity 25, and may be shaped as a bump, dimple, node, prominence, protuberance, or other like projection. The first convexity 25 and the second convexity 26 may extend oppositely from each other from the body 37.

The first and second convexities 25, 26 may define between them an axis of rotation 38.

Various shapes of the body 37 may be utilized, as may be advantageous in particular applications. In some embodiments, the clamp 20 may include a leg 31 extending from the body 37, to form the first end 21, and a riser 34 extending from the body 37, to form the second end 22. Thus, in such embodiments, the first convexity 25 may extend from the leg 31. In those embodiments in which a second convexity 26 is included, the second convexity 26 may likewise extend from the leg 31. Further in such embodiments, the clamp 20 may be understand to include a keeper 32, the keeper 32 being disposed between the leg 31 and the riser 34. A lower profile 33 may reside upon the body 37.

The pivoting mesh shelf locking clamp 20 may also include a first arm 23 in some applications, the first arm 23 extending from the body 37 proximate to the second end 22. With those embodiments that include a riser 34, the first arm may extend from the riser 34. The first arm 23 may be resiliently bendable. In some examples, the first arm 23 may be resiliently bendable in a plane parallel to the axis of rotation 38 either defined by the first convexity 25 or, in those embodiment with both first and second convexities 25, 26, defined by the first and second convexities 25, 26.

In certain configurations, the clamp 20 may also include a second arm 24, the second arm 24 extending from the body 37 proximate to the second end 22. With those embodiments that include a riser 34, the second arm 24 may extend from the riser 34. The second arm 24 may be resiliently bendable and, in individual examples, the second arm 24 may be resiliently bendable in a plane parallel to the axis of rotation 38.

With selective embodiments, only one of the first and second arms 23, 24 may be resiliently bendable. As to other embodiments, both the first and second arms 23, 24 may be resiliently bendable. Specific representations include first and second arms 23, 24 that are parallel to each other. Still further, other instances include first and second arms 23, 24 that are parallel to each other and both are resiliently bendable. In yet other examples, the first and second arms 23, 24 are parallel to each other, and are both resiliently bendable in a plane parallel to the axis of rotation 38.

Either or both of the first arm 23 and second arm 24 may terminate in a hook 27, 28, respectively. Specifically, the first arm 23 may terminate in a first hook 27 and the second arm 24 may terminate in a second hook 28. Particular examples of such first hook 27 and/or second hook 28 may also include, respectively, a first bevel 29 and a second bevel 30. First bevel 29 and a second bevel 30 may aid in the insertion of hooks 27, 28 into mount apertures 52*a*, 52*b* as described below.

The pivoting mesh shelf locking clamp 20 may be used with a shelving system that includes a mount, such as a mounting rail 40. The exemplary embodiments discussed herein, only for purposes of illustration, refer to a mounting rail 40 as providing a mount. Other mounts that are not mounting rails 40, however, may be used with the present invention. In some embodiments, such as stand-alone shelving systems, no mount or mounting rail 40 may be used at all, and bracket mounts 50, 51 (described in more detail below) may be free standing or may be suspended from above. Nevertheless, only for purposes of illustration, an exemplary mount is described that is a mounting rail 40, the mounting rail 40 being linear and mounted horizontally upon a wall W.

The subject locking clamp 20 may be used with a shelving system that includes one or more bracket mounts 50, 51. Illustrated herein is a type of bracket mount 50, 51 that is a linear member, but such a design is not limiting. A bracket mount 50, 51 may be any structure that provides for the mounting of a bracket 60, 61 for a shelving system. A bracket mount 50, 51 may define one or more mount apertures 52. Certain embodiments, in fact, define a plurality of mount apertures, such as mount apertures 52*a*, 52*b*. In some embodiments of linear bracket mounts 50, 51, such as the exemplary embodiments illustrated herein, the mount apertures 52*a*, 52*b* are arranged along a portion of the length of the bracket mounts 50, 51. In certain configurations, the mount apertures 52 are arranged in pairs, side-by side, along a portion of the length of the bracket mounts 50, 51.

The shelving system with which the subject pivoting mesh shelf locking clamp 20 may be used may also include one or more brackets 60, 61. A bracket 60, 61 is a structure that supports a shelf 80, 81. Such a bracket 60, 61 may be one or more of a variety of configurations that allow for the insertion into a bracket aperture 62, 63 of one or more convexity 25, 26 of the clamp 20 and for the pivoting or rotating of the clamp 20 relative to the bracket 60, 61. Thus, a bracket 60, 61 may define, for example, a first bracket aperture 62 and a second bracket aperture 63, each disposed to receive therethrough one of the first convexity 25 and second convexity 26. In other representative embodiments, with which only a single convexity 25 or 26 extends from the body 37, only a single bracket aperture 62 or 63 need be defined, for receipt therein on the single convexity 25 or 26.

A bracket 60, 61 may include one or more fingers, such fingers 64, 65, 66, extending rearwardly from the bracket 60, 61. For example, a particular bracket 60, 61 may include a first attachment finger 64, a second attachment finger 65, and a third attachment finger 66. Such attachment fingers 64, 65, 66 may allow for attachment of the bracket 60, 61 to a bracket mount 50, 51, as will be described hereinbelow in more detail.

A bracket 60, 61 may also define a first rail slot 67, such first rail slot 67 located upon the upper aspect of the bracket 60, 61, toward the rear of the bracket 60, 61. The first rail slot 67 may be sized to receive therein a first crossbar 83 of a shelf 80, 81. More specifically, the first rail slot 67 may be sized so as receive fully therein the cross-section a first crossbar 83 of a shelf 80, 81, thereby providing for the shelf 80, 81 to be positioned upon the bracket 60, 61 horizontal from back to front.

In certain configurations of shelving systems, in which a first shelf 80 and a second shelf 81 are nested with each other, the bracket 60, 61 may also define a first rail slot 67 and a second rail slot 68, such first and second rail slots 67, 68 located upon the upper aspect of the bracket 60, 61, toward the rear of the bracket 60, 61. The first rail slot 67 may be sized so as receive fully therein the cross-section a first crossbar 83 of the first shelf 80, thereby providing for the first shelf 80 to be positioned upon the bracket 60, 61 horizontal from back to front. The second rail slot 68 may be sized so as receive fully therein the cross-section a second crossbar 84 of the second shelf 81, thereby likewise providing for the second shelf 81 to be positioned upon the bracket 60, 61 horizontal from back to front.

The shelving system with which the subject pivoting mesh shelf locking clamp 20 may be used may also include one or more shelves 80, 81. The nomenclature used herein refers to a mesh shelf 80, 81. The mesh shelf 80, 81 itself may have one or more different webbings forming the shelf surface; the exemplary embodiment illustrated herein provides for wires 85*a*, 85*b* extending from back to front across the shelf width 82, the wires 85*a*, 85*b* being spaced apart and perpendicular to the rear crossbar 83, 84. Other embodiments of a mesh shelf 80, 81 may have other mesh configurations that are not wires. Such a shelf 80, 81 may include a crossbar 83, 84 residing along at least a portion of the rear length of the shelf 80, 81 below wires 85*a*, 85*b*.

In some instances, both a first shelf 80 and second shelf 81 may be used, the first shelf 80 and the second shelf 81 nested together. Such configurations involve the second shelf 81 being wider than the first shelf 80 such that, when installed, the second crossbar 84 of the second shelf 81 resides rearward of the first crossbar 83 of the first shelf 80.

Thus, a shelving system may be configured. As noted above, a mount such as a mounting rail 40 may be used and such an arrangement will be described herein for illustration purposes, though with some embodiments, such as stand-alone shelving systems, no mount is necessary, and in other embodiments a mount may be used that is not a rail. The mount may be attached to a vertical wall W. In some applications, the mounting rail 40 may be attached horizontally upon the wall, which may also provide the flexibility of side-to-side adjustment of bracket mounts 50, 51.

One or more bracket mounts 50, 51 may then be attached to the mounting rail 40. For illustration purposes herein, linear bracket mounts 50, 51 are described, but other configurations of bracket mounts 50, 51 may similarly be used. The bracket mounts 50, 51 may define one or more mount apertures 52, such as mount apertures 52*a*, 52*b*, arranged along a portion of the length of the bracket mounts 50, 51 in pairs, side-by side, along a portion of the length of the bracket mounts 50, 51.

One or more brackets 60, 61 may then be attached to the bracket mounts 50, 51. In the illustrated embodiment, the brackets 60, 61 may include a first attachment finger 64, a second attachment finger 65, and a third attachment finger 66. The attachment fingers 64, 65, 66 are spaced apart from each other in such a configuration as to allow each to be inserted into mount apertures 52 in a bracket mount 50, 51.

A bracket 60, 61 also may define first rail slot 67 located upon the upper aspect of the bracket 60, 61, toward the rear of the bracket 60, 61. The first rail slot 67 may be sized so as receive fully therein the cross-section a first crossbar 83 of a first shelf 80, thereby providing for the shelf to be positioned upon the bracket 60, 61 horizontal from back to front. The bracket 60, 61 also may define a second rail slot 68 located upon the upper aspect of the bracket 60, 61, toward the rear of the bracket 60, 61. The second rail slot 68 may be sized so as to receive fully therein the cross-section a second crossbar 84 of a second shelf 81, thereby likewise providing for the second shelf 81 to be positioned upon the bracket 60, 61 horizontal.

One or more shelves 80, 81 may then be added to the system, by placing it/them upon the bracket 60, 61. For illustration purposes, suppose both a first shelf 80 and second shelf 81 are used, the first shelf 80 and the second shelf 81 nested together, the second shelf 81 being wider than the first shelf 80 with the second crossbar 84 of the second shelf 81 residing rearward of the first crossbar 83 of the first shelf 80. The first crossbar 83 may reside in the first rail slot 67 and the second crossbar 84 may reside in the second rail slot 68.

The bracket 60, 61 may define first bracket aperture 62 and a second bracket aperture 63, each disposed to receive therethrough one of the first convexity 25 and second convexity 26 of the subject clamp 20. The subject clamp 20 may thus be attached to the bracket 60, 61—it may be attached before assembly of the bracket 60, 61 to the first bracket mount 50, or it may be added thereafter.

The clamp 20 may have a first end 21 and an opposite second end 22. The clamp 20, in this illustration, may include a first convexity 25 and a second convexity 26 extending from the body 37 proximate the first end 21. The first convexity 25 and the second convexity 26 may extend oppositely from each other from the body 37, and may define between them an axis of rotation 38.

A lower profile 33 may be defined on the lower aspect of the clamp body 37, between the first end 21 and the second end 22.

The clamp 20 may also include a first arm 23 and second arm 24, each extending from the body 37 proximate to the second end 22. For purposes of illustration, both the first and second arms 23, 24 may be resiliently bendable and may be parallel to each other. Both may be resiliently bendable in a plane parallel to the axis of rotation 38 defined by the first and second convexities 25, 26.

Both the first arm 23 and second arm 24 may terminate in a hook.

The clamp 20 may be rotatable about the axis of rotation 38. Therefore, to install the first and second shelves 80, 81 upon the bracket 60, 61, the clamp 20 may be rotated in a Direction O, toward the front of the bracket 60, 61 and away from the rail slots 67, 68, so as to expose the rail slots 67, 68 for receipt of the first and second crossbars 83, 84, in which position the clamp 20 may be understood to be an unlocked position. The first and second nested shelves 80, 81 are then installed upon the bracket 60, 61, with the first crossbar 83 residing in the first rail slot 67 and the second crossbar 84 resides in the second rail slot 68 (in some designs, the first rail slot 67 may be dimensioned sufficiently wide as to receive therein both the first crossbar 83 and the second crossbar 84).

Once the shelves 80, 81 are installed, the clamp 20 may be rotated in a Direction L, which is opposite Direction O, toward the back of the bracket 60, 61 and toward the rail slots 67, 68. The lower profile 33 thereby nears the first and second crossbars 83, 84.

The first and second arms 23, 24 may be positioned a predetermined distance from the lower profile 33, and at a predetermined distance from each other, such that, when the lower profile 33 nears the first and second crossbars 83, 84, the first and second arms 23, 24 may be properly positioned so that the respective hooks 27, 28 at their termini may be inserted into mount apertures 52*a*, 52*b* in the first bracket mount 50. First and second bevels 29, 30, included with the first and second hooks 27, 28, respectively, may aid such insertion. Once so arranged, the clamp 20 may be understood to be in a locked position.

It will be further understood that, because the first and second arms 23, 24 may be resilient, the clamp 20 may be moved from a locked position to an unlocked position by urging the first and second arms 23, 24 away from their first and second hooks 27, 28, respectively, whereby the hooks may be removed from the mount apertures 52*a*, 52*b* in the bracket mounts 50, 51, and the clamp 20 then rotated in Direction O.

The appended drawings illustrate embodiments of the pivoting mesh shelf locking clamp 20 of the present invention. FIGS. 1, 5, 6, 7, and 8 illustrate various aspects of the clamp 20. The clamp 20 has a body 37 with a first end 21 and a second end 22 and a lower profile 33 residing between the first end 21 and the second end 22. The clamp 20 includes a first convexity 25 extending from the body 37 proximate the first end 21. The clamp 20 also includes a second convexity 26 extending oppositely from the first convexity 25. The first and second convexities 25, 26 define between them an axis of rotation 38.

The clamp 20 includes a leg 31 extending from the body 37, to form the first end 21, and a riser 34 extending from the body 37, to form the second end 22. The clamp 20 includes a keeper 32, the keeper 32 being disposed between the leg 31 and the riser 34. The lower profile 33 resides upon the keeper 32.

The pivoting mesh shelf locking clamp 20 also includes a first arm 23 extending from the body 37 proximate to the second end 22. The first arm 23 extends from the riser 34 and is resiliently bendable in a plane parallel to the axis of rotation 38 defined by the first and second convexities 25, 26. The clamp 20 also includes a second arm 24, the second arm 24 extending from the body 37 proximate to the second end 22. The second arm 24 extends from the riser 34 and is resiliently bendable in a plane parallel to the axis of rotation 38 defined by the first and second convexities 25, 26. The first and second arms 23, 24 that are parallel to each other. Both the first arm 23 and the second arm 24 terminates in a hook. The first hook 27 and the second hook 28 also include, respectively, a first bevel 29 and a second bevel 30.

FIGS. 2, 3, 4, and 9 illustrate other aspects of the pivoting mesh shelf locking clamp 20 with an example of a shelf system. The clamp 20 is used with a shelving system that includes a mounting rail 40 and bracket mounts 50, 51. Illustrated herein is a type of bracket mount 50, 51 that is a linear member. The bracket mount 50, 51 defines plural mount apertures 52, which are arranged along a portion of the length of the bracket mount 50, 51 in pairs, side-by side. The shelving system also includes brackets 60, 61. Each bracket 60, 61 defines a first bracket aperture 62 and a second bracket aperture 63, disposed to receive therethrough one of the first convexity 25 and second convexity 26. Each bracket 60, 61 also includes a first attachment finger 64, a second attachment finger 65, and a third attachment finger 66 extending rearwardly from the bracket 60, 61.

Each bracket 60, 61 defines a first rail slot 67 and a second rail slot 68, such first and second rail slots 67, 68 located upon the upper aspect of the bracket 60, 61, toward the rear of the bracket 60, 61. The first rail slot 67 is sized so as receive fully therein the cross-section a first crossbar 83 of a first shelf 80, thereby providing for the first shelf 80 to be positioned upon the bracket 60, 61 to be horizontal. The second rail slot 68 is sized so as receive fully therein the cross-section a second crossbar 84 of the second shelf 81, thereby likewise providing for the second shelf 81 to be positioned upon the bracket 60, 61 to be horizontal.

The shelving system also includes shelves 80, 81. Each shelf includes a crossbar residing along at least a portion of the rear length of the shelf. Each shelf also has webbing forming the shelf surface—wires 85*a*, 85*b* extending from back to front across each shelf width 82, the wires 85*a*, 85*b* being spaced apart and perpendicular to the rear crossbar.

Both a first shelf 80 and second shelf 81 are used (see FIG. 9), the first shelf 80 and the second shelf 81 nested together, the second shelf 81 being wider than the first shelf 80 such that the second crossbar 84 of the second shelf 81 resides rearward of the first crossbar 83 of the first shelf 80.

Linear bracket mounts 50, 51 are attached to the mounting rail 40. The bracket mounts 50, 51 define plural mount apertures 52 arranged along a portion of the length of the bracket mount 50, 51 in pairs, side-by side.

Figure 2:
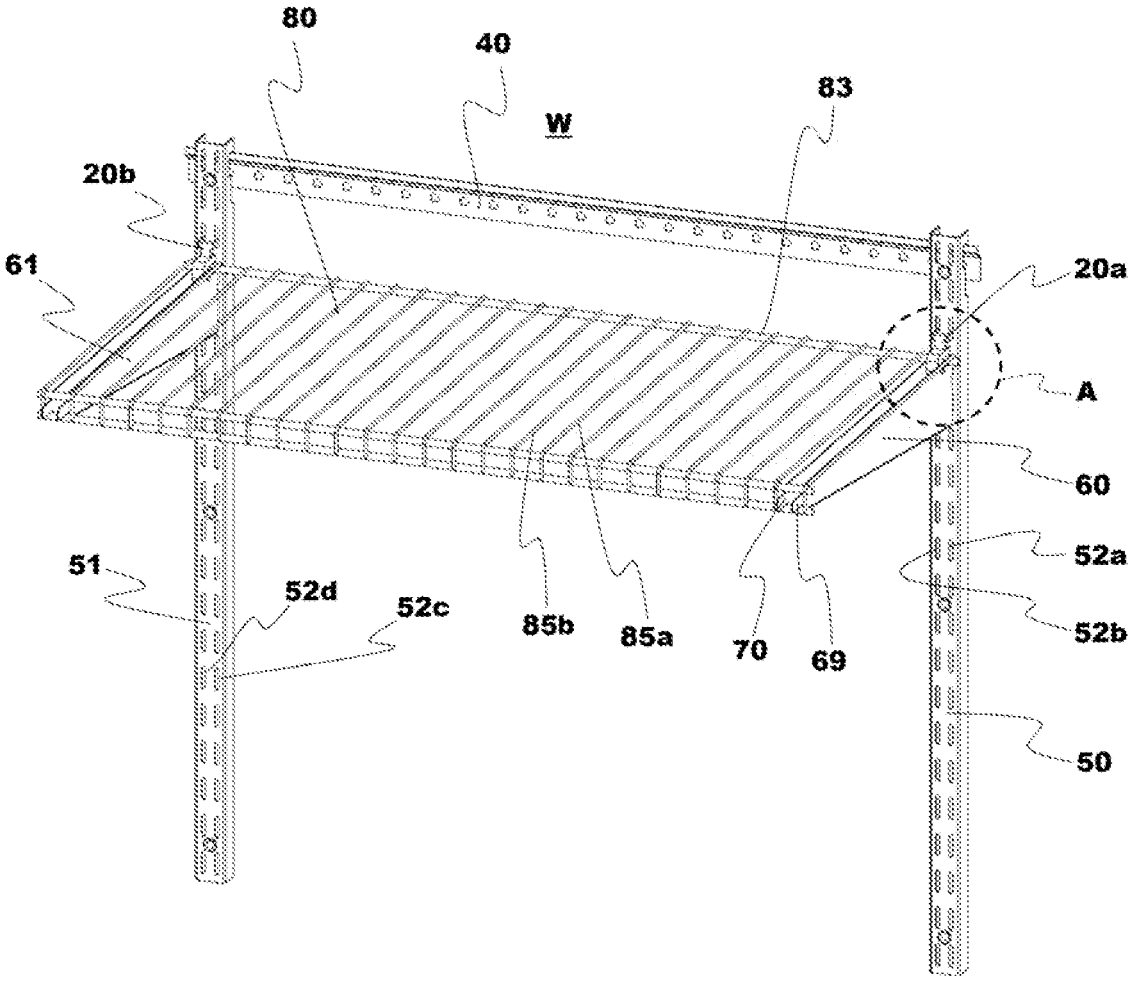
FIG. 2 is a perspective view of a mesh shelf system according to an embodiment of the present invention.

An embodiment of a pivoting mesh shelf locking clamp 20 used in a shelving system is illustrated in FIG. 2.

FIG. 2 is illustrates linear bracket mounts 50, 51 defining plural mount apertures 52, such as 52*a*, 52*b*, 52*c*, and 52*d*. The mount apertures 52*a*, 52*b*, 52*c*, and 52*d* are arranged along portions of the lengths of the bracket mounts 50, 51, in this example being arranged in pairs, side-by-side, along portions of the lengths of the bracket mounts 50, 51.

In the embodiment illustrated in FIG. 2, a mounting rail 40 has been attached to a wall W. Bracket mounts 50 and 51 have, in turn, been attached to mounting rail 40.

A bracket 60 has been attached to the bracket mount 50 and a bracket 61 has been attached to bracket mount 51. Brackets 60, 61 in FIG. 2 may each have a single first rail slot 67 that has been sized to accommodate first crossbar 83 of a first shelf 80.

The shelf 80 in FIG. 2 has wires, for example wires 85*a*, 85*b*, extending from back to front across shelf 80, the wires, for example wires 85*a*, 85*b*, being spaced apart and perpendicular to the rear crossbar 83.

In FIG. 2, the embodiment illustrates clamps 20*a*, 20*b* that have been rotated toward the back of the brackets 60, 61, respectively. First arm 23 and second arm 24 of each respective claim 20*a*, 20*b* have been interfitted into mount apertures 52, locking the clamps 20*a*, 20*b* in place and locking first crossbar 83 in place in the shelving system.

Figure 3:
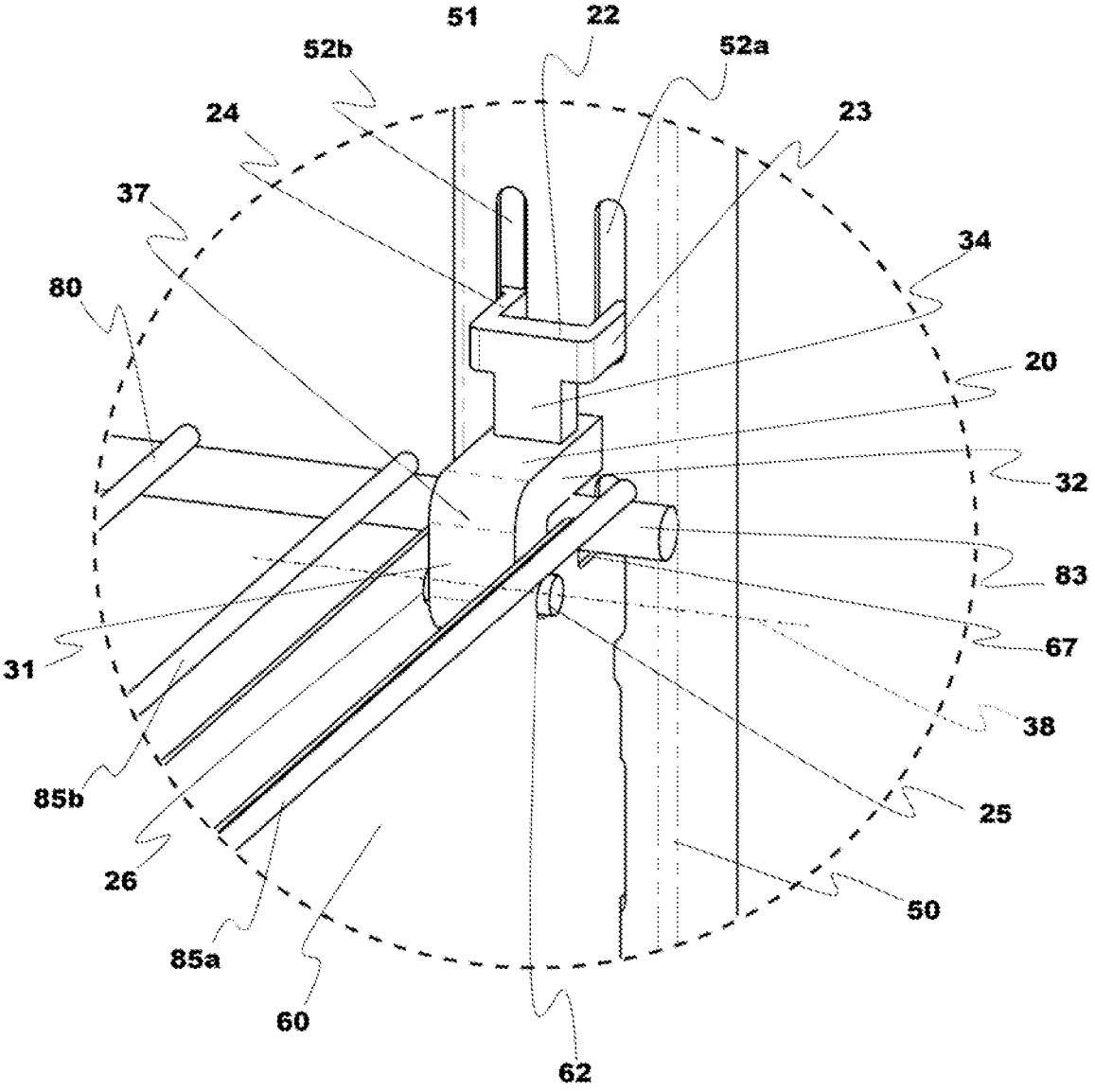
FIG. 3 is close-up perspective view of a mesh shelf system, taken at A in FIG. 2, according to an embodiment of the present invention.

FIG. 3 illustrates an embodiment of a clamp 20 that includes a first convexity 25 extending from the body 37 proximate the first end 21 and a second convexity 26 extending oppositely from the first convexity 25, defining between them an axis of rotation 38. Clamp 20 includes a leg 31 extending from the body 37, to form the first end 21, and a riser 34 extending from the body 37, to form the second end 22. Clamp 20 also includes a keeper 32, the keeper 32 being disposed between the leg 31 and the riser 34. Clamp 20 also includes a first arm 23 extending from the riser 34, and a second arm 24 extending from the riser 34. First arm 23 and second arm 24 may be resiliently bendable in a plane parallel to the axis of rotation 38. First arm 23 and second arm 24 each terminate in a hook 27, 28, respectively (not shown in FIG. 3).

Clamp 20 is illustrated in FIG. 3 as being used with a shelving system that includes a bracket mount 50. Illustrated in FIG. 3 is a bracket mount 50 that is a linear member. Bracket mount 50 defines mount apertures 52*a*, 52*b*, arranged side-by side.

A bracket 60 is also illustrated in FIG. 3. Bracket 60 allows for the insertion into a bracket aperture 62, 63 (63 not shown in FIG. 3) of convexities 25, 26 of the clamp 20 and for the pivoting or rotating of the clamp 20 relative to the bracket 60.

The bracket 60 of FIG. 3 also defines a first rail slot 67, first rail slot 67 located upon the upper aspect of the bracket 60 toward the rear of the bracket 60. The first rail slot 67 has been sized to receive therein a first crossbar 83 of a shelf 80.

The shelving system illustrated in FIG. 3 includes shelf 80. Shelf 80 includes a crossbar 83 residing along at least a portion of the rear length of the shelf 80. Shelf 80 includes wires 85*a*, 85*b* extending from back to front across the width of shelf 80, the wires 85*a*, 85*b* being spaced apart and perpendicular to the rear crossbar 83.

Thus, in FIG. 3, bracket 60 is illustrated as attached to bracket mount 50. Bracket 60 defines first rail slot 67 located upon the upper aspect of the bracket 60, toward the rear of the bracket 60. The first rail slot 67 has been sized so as receive fully therein the cross-section a first crossbar 83 of a first shelf 80, thereby providing for the shelf to be positioned upon the bracket 60 horizontal. Shelf 80 is illustrated as having been placed upon the bracket 60. The bracket 60 defines first bracket aperture 62 and a second bracket aperture 63 (not shown in FIG. 3), each having received therethrough one of the first convexity 25 and second convexity 26, respectively, of the subject clamp 20. The subject clamp 20 has thus been attached to the bracket 60. Lower profile 33, defined on the lower aspect of the clamp body 37, covers and locks into place first crossbar 83 of first shelf 80 in first rail slot 67.

Figure 4:
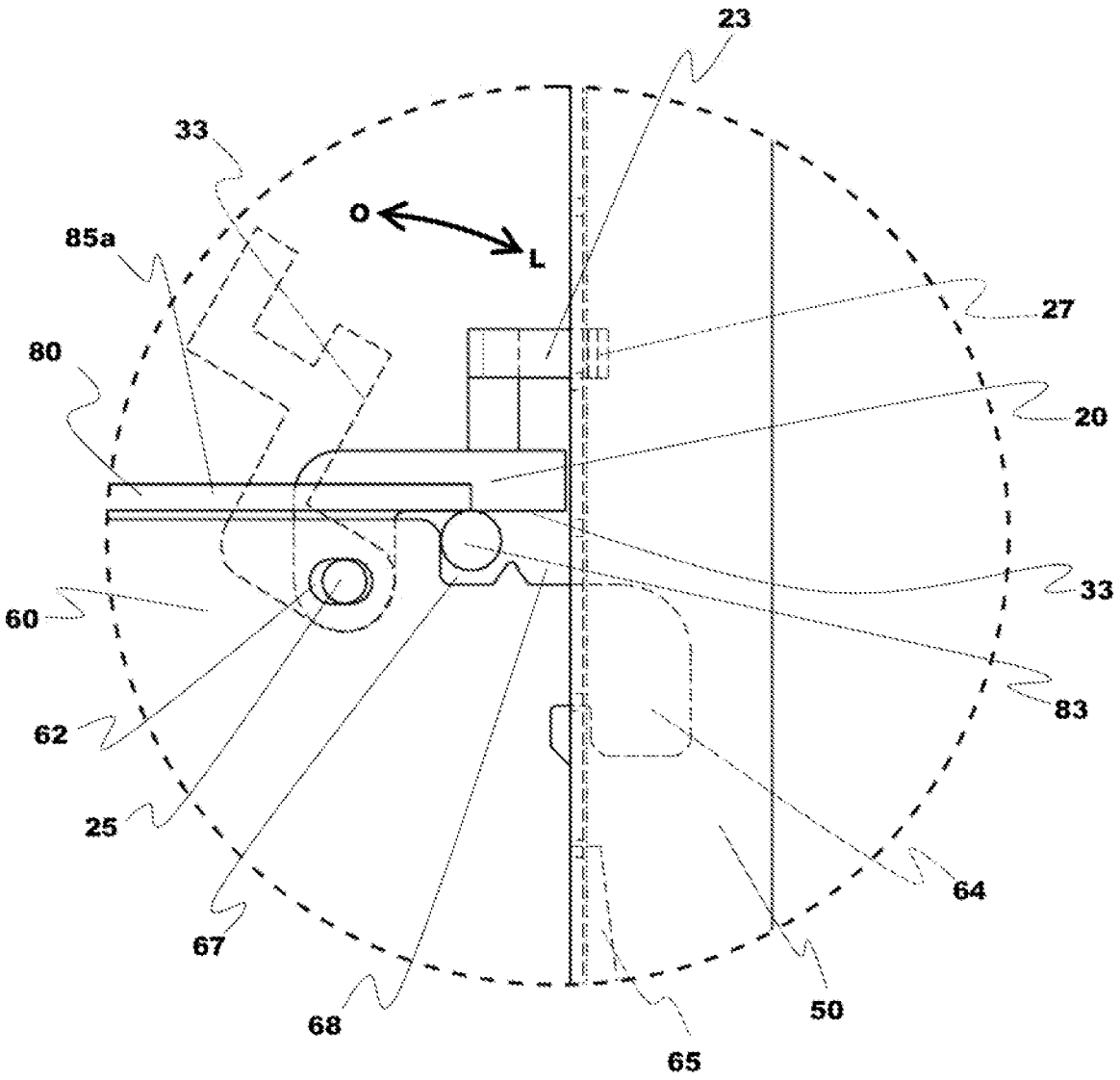
FIG. 4 is close-up side elevation view of a mesh shelf system, taken at A in FIG. 2, according to an embodiment of the present invention.
Figure 5:
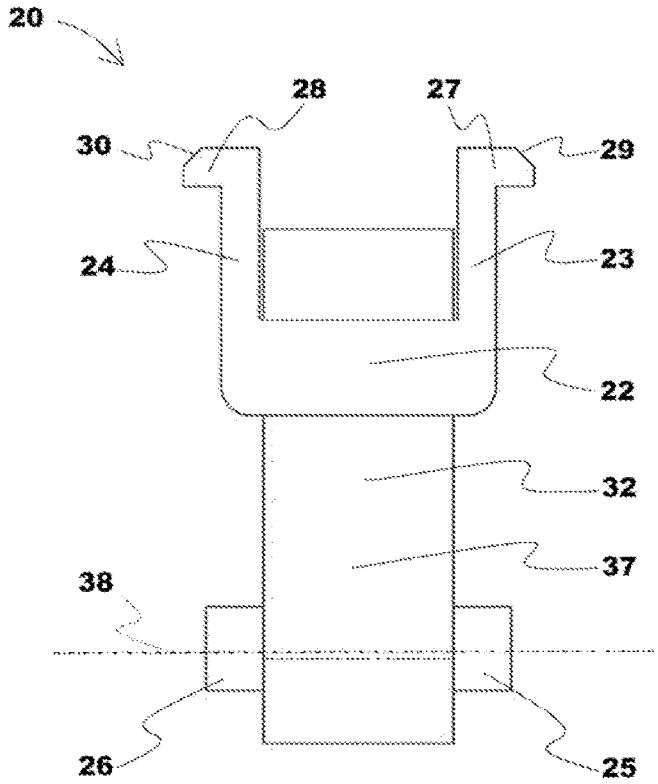
FIG. 5 is top plan view of a pivoting mesh shelf locking clamp according to an embodiment of the present invention.
Figure 6:
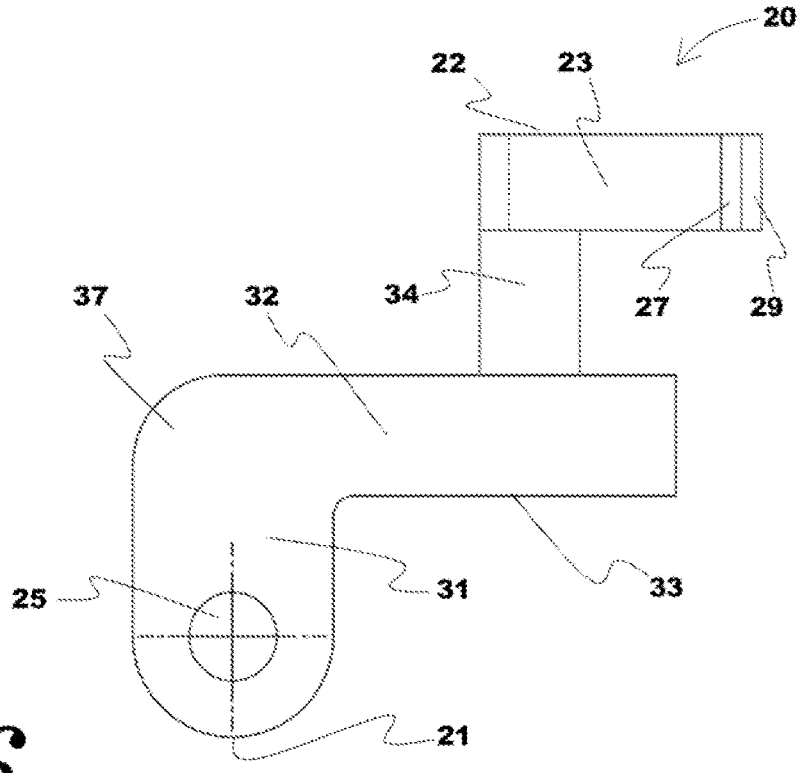
FIG. 6 is right side elevation view of a pivoting mesh shelf locking clamp according to an embodiment of the present invention.
Figure 7:
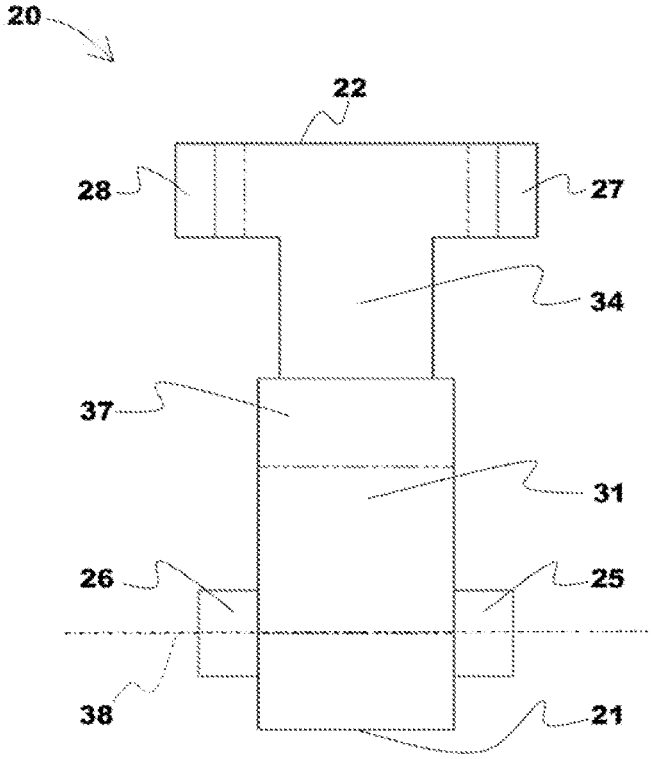
FIG. 7 is front elevation view of a pivoting mesh shelf locking clamp according to an embodiment of the present invention.
Figure 8:
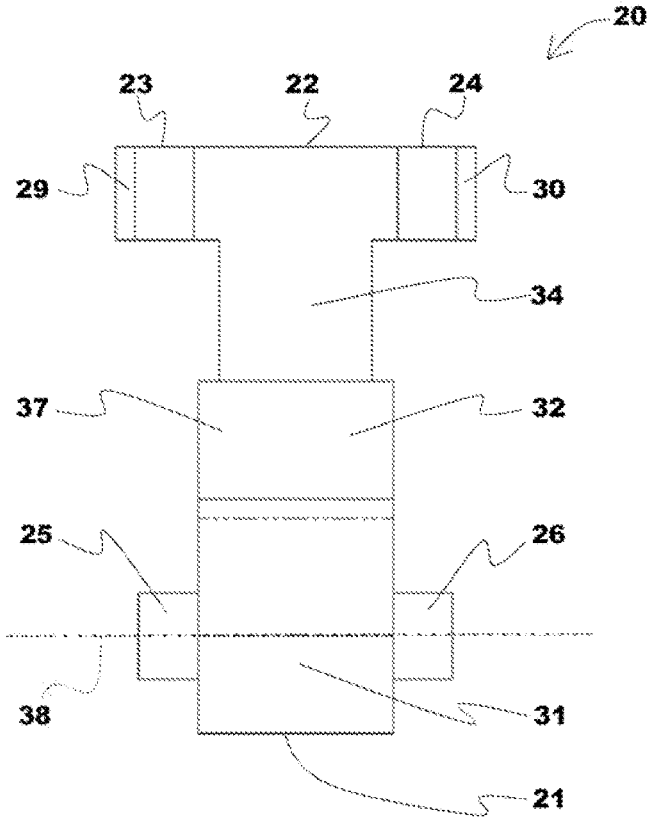
FIG. 8 is rear elevation view of a pivoting mesh shelf locking clamp according to an embodiment of the present invention.

FIG. 4 illustrates an embodiment of a clamp 20 that includes a first convexity 25 extending from the body 37 proximate the first end 21. Clamp 20 includes a leg 31 extending from the body 37, to form the first end 21, and a riser 34 extending from the body 37, to form the second end 22. Clamp 20 also includes a keeper 32, the keeper 32 being disposed between the leg 31 and the riser 34. Clamp 20 also includes a first arm 23 extending from the riser 34. First arm 23 terminates in a hook 27, which includes a first bevel 29. The clamp 20 includes a first convexity 25 extending from the body 37 proximate the first end 21. Lower profile 33, defined on the lower aspect of clamp body 37, resides upon the keeper 32.

The pivoting mesh shelf locking clamp 20 is illustrated in FIG. 4 in use with a linear bracket mount 50 and a bracket 60. Bracket 60 includes a bracket aperture 62 into which convexity 25 of the clamp 20 has been inserted, allowing for the pivoting or rotating of the clamp 20 relative to the bracket 60. Bracket 60 includes fingers 64, 65 extending rearwardly from the bracket 60. Bracket 60 also defines a first rail slot 67, first rail slot 67 located upon the upper aspect of the bracket 60 toward the rear of the bracket 60. The first rail slot 67 has been sized to receive therein a first crossbar 83 of a shelf 80. More specifically, the first rail slot 67 may be sized so as receive fully therein the cross-section a first crossbar 83 of a shelf 80, thereby providing for the shelf 80 to be positioned upon the bracket 60 horizontally.

The clamp 20 illustrated in FIG. 4 may be rotatable about the axis of rotation 38 defined at first convexity 25. Therefore, to install the first shelf 80 upon the bracket 60, the clamp 20 may be rotated in a Direction O, toward the front of the bracket 60 and away from the rail slot 67 so as to expose the rail slot 67 for receipt of the first crossbar 83. The first shelf 80 may then be installed upon the bracket 60, with the first crossbar 83 residing in the first rail slot 67. Once the shelf 80 is installed, as illustrated in FIG. 4, the clamp 20 may be rotated in a Direction L, which is opposite Direction O, toward the back of the bracket 60 and toward the rail slot 67. The lower profile 33 thereby nears the first crossbar 83. The first and second arms 23, 24 have been positioned a predetermined distance from the lower profile 33, and at a predetermined distance from each other, such that, when the lower profile 33 nears the first crossbar 83, the first and second arms 23, 24 are properly positioned so that the respective hooks 27, 28 at their termini may be inserted into mount apertures 52*a*, 52*b* in the first bracket mount 50. Once so arranged, which is the arrangement illustrated in FIG. 4, the clamp 20 may be understood to be in a locked position.

Figure 9:
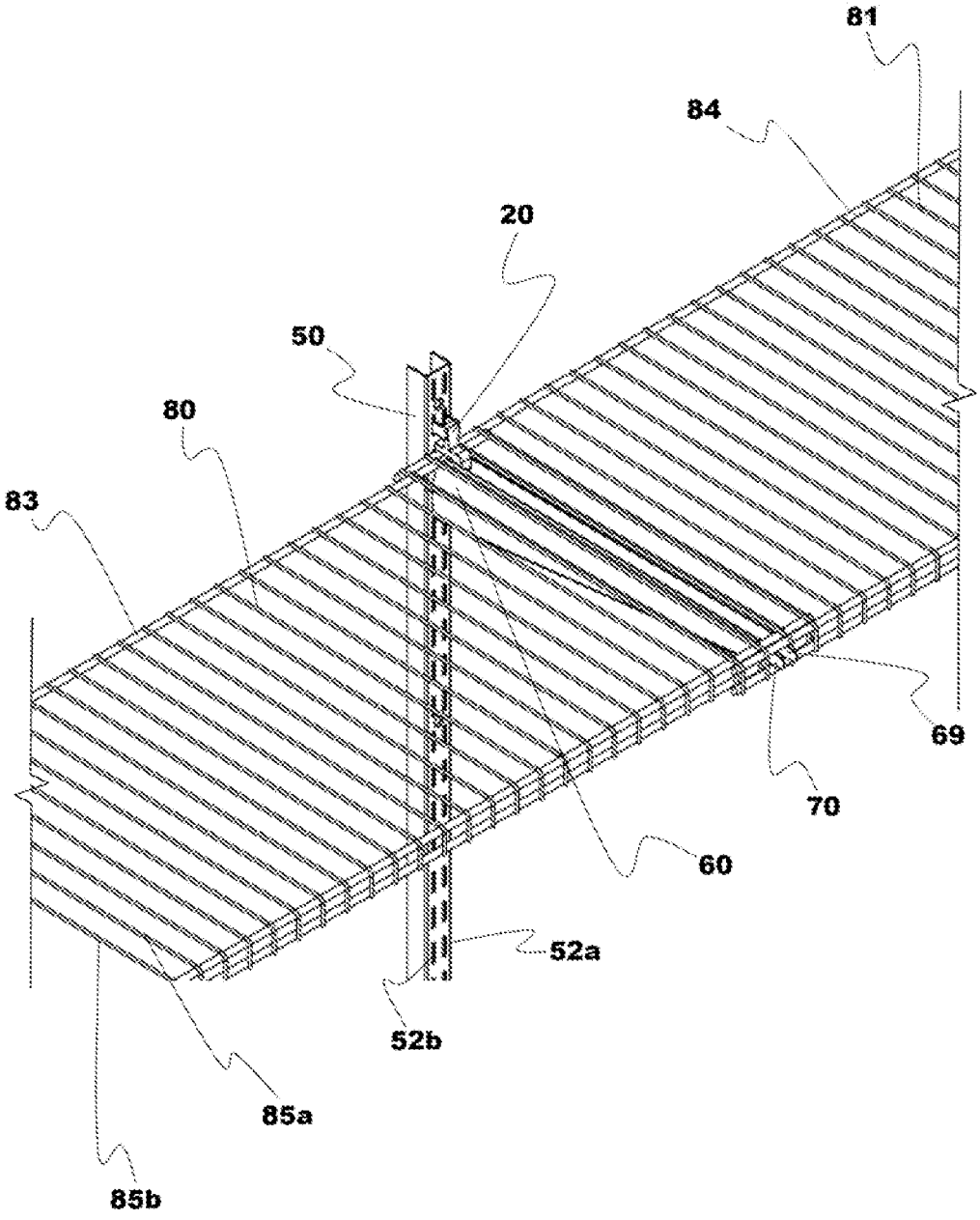
FIG. 9 is a broken perspective view of a mesh shelf system according to an embodiment of the present invention.

An embodiment of a pivoting mesh shelf locking clamp 20 used in a shelving system is illustrated in FIG. 9.

Illustrated in FIG. 9 is a type of bracket mount 50 that is a linear member that defines one or more mount apertures 52, such as mount apertures 52*a* and 52*b*. The mount apertures 52*a*, 52*b* are arranged along a portion of the length of the bracket mount 50, in this example being arranged in pairs, side-by side, along a portion of the length of the bracket mount 50.

A bracket 60 has been attached to the bracket mount 50. Bracket 60 in FIG. 9 may have either a single first rail slot 67 that has been sized to accommodate both a first crossbar 83 of a first shelf 80 and a second crossbar of a second shelf 81, or a first rail slot 67 that has been sized to accommodate a first crossbar 83 of a first shelf 80 and a second rail slot 68 that has been sized to accommodate a second crossbar 84 of a second shelf 81.

The shelving system illustrated in FIG. 9 includes two mesh shelves 80, 81. The mesh shelves 80, 81 have wires, for example wires 85*a*, 85*b*, extending from back to front across the shelves 80, 81, the wires, for example wires 85*a*, 85*b*, being spaced apart and perpendicular to the rear crossbar 83, 84. In the embodiment illustrated in FIG. 9, the first shelf 80 and the second shelf 81 are nested together, the second shelf 81 being wider than the first shelf 80 such that the second crossbar 84 of the second shelf 81 resides rearward of the first crossbar 83 of the first shelf 80.

In FIG. 9, the embodiment illustrates a clamp 20 that has been rotated toward the back of the bracket 60. First arm 23 and second arm 24 have been interfitted into mount apertures 52, locking the clamp 20 in place and locking first crossbar 83 and second crossbar 84 in place in the shelving system.

Figure 10:
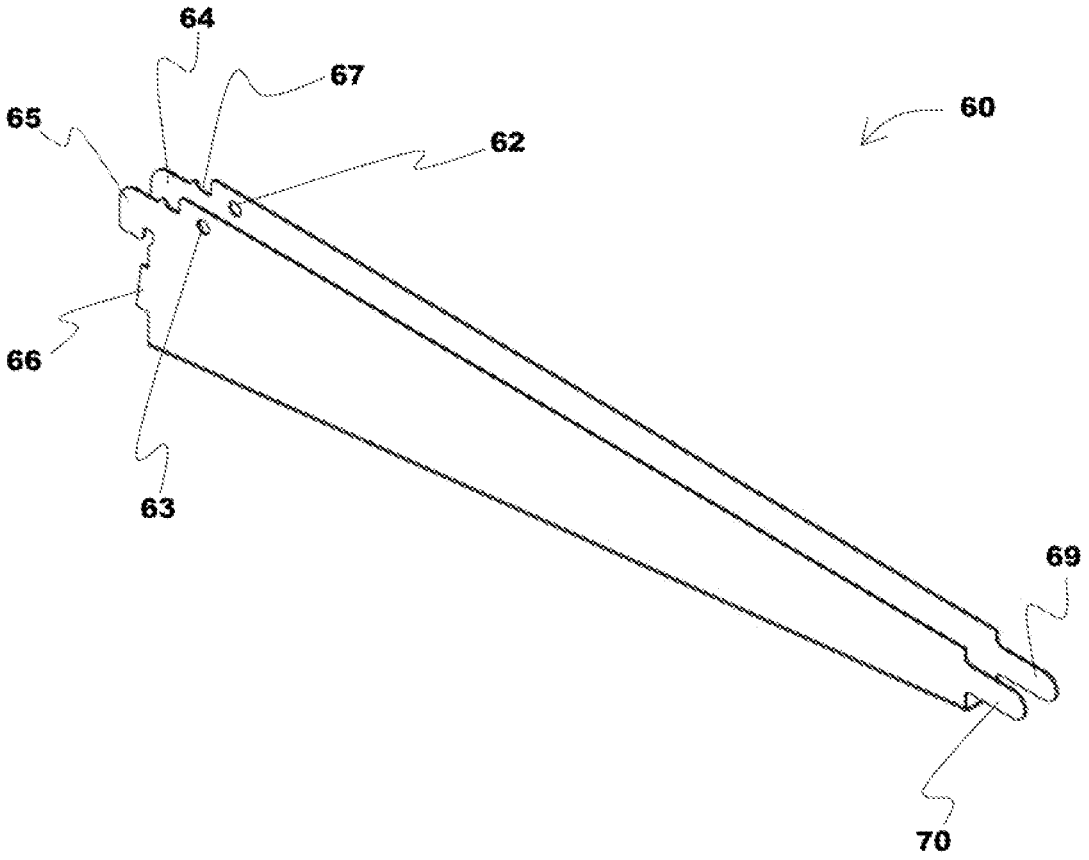
FIG. 10 is a perspective view of a bracket of a mesh shelf system according to an embodiment of the present invention.

FIG. 10 illustrates an embodiment of a bracket 60. Such a bracket 60 may include first attachment finger 64, second attachment finger 65, and third attachment finger 66. To interfit a clamp 20, first and second bracket apertures 62, 63 may be defined in bracket 60. If advantageous for particular applications, bracket 60 may also include first and second forward projections 69, 70, that may interfit with front features of a shelf 80, such as illustrated in FIGS. 2 and 9.

It should be understood that, in the above description of embodiments, various features have sometimes been grouped together in a single embodiment, figure, or description for the purpose of streamlining the disclosure and aiding in the understanding of one or more of the various inventive aspects. This method of disclosure, however, is not be interpreted as reflecting an intention that any individual claim requires more features than are expressly recited in that particular claim. Moreover, any components, features, or steps illustrated and/or described in a particular embodiment herein can be applied to or used with any other embodiment. Thus, it is intended that the scope of the inventions herein disclosed should not be limited by the particular embodiments described above, but should be determined only by a fair reading of the claims that may issue with the benefit of the within disclosure.

The invention claimed is:

1. A method of locking a mesh shelf, comprising the steps of:

providing a bracket mount;

attaching a bracket to the bracket mount;

providing a pivotable mesh shelf locking clamp comprising: a body, the body having a first end and an opposite second end; a first convexity extending from the body proximate to the first end; a first arm extending from the body proximate to the second end; the body defining a lower profile between the first convexity and the first arm; the clamp rotatable about the first convexity relative to a shelf bracket, between a first unlocked position and a second unlocked position;

attaching the mesh shelf locking clamp to the bracket;

positioning the mesh shelf locking clamp in the first unlocked position;

placing a mesh shelf with a rear crossbar upon the bracket with the rear crossbar proximate to the bracket mount; and rotating the mesh shelf locking clamp to the second locked position.

2. A mesh shelf system, comprising:

a bracket mount;

a bracket, the bracket attached to the bracket mount;

a mesh shelf, the mesh shelf carried by the bracket, the mesh shelf including a first crossbar residing proximate to the bracket mount; and a mesh shelf locking clamp, the mesh shelf locking clamp attached to the bracket, the mesh shelf locking clamp being rotatable relative to the bracket between a first position away from the first crossbar and a second position in which the mesh shelf locking clamp covers a portion of the first crossbar.

3. The mesh shelf system of claim 2, in which the mesh shelf locking clamp is selectively detachable from the bracket.

4. The mesh shelf system of claim 2, in which the mesh shelf locking clamp is selectively attachable and detachable from the bracket mount.

5. The mesh shelf system of claim 2, in which the mesh shelf locking clamp defines an axis of rotation and in which the mesh shelf locking clamp includes first and second arms, the first and second arms being resilient in a plane parallel to the axis of rotation.

6. The mesh shelf system of claim 2, further including a second crossbar residing proximate to the bracket mount, the mesh shelf locking clamp covering a portion of the second crossbar when the mesh shelf locking clamp is in the second position.

7. The mesh shelf system of claim 2, in which:

the bracket mount defines plural mount apertures;

the mesh shelf locking clamp defines an axis of rotation;

the mesh shelf locking clamp includes first and second arms, the first and second arms being resilient in a plane parallel to the axis of rotation; and each of the first and second arms terminate in hooks, the hooks being interfitted into separate mount apertures when the mesh shelf locking clamp is in the second position.

8. A mesh shelf system, comprising:

a bracket mount, the bracket mount defining a plurality of mount apertures;

a bracket, the bracket attached to the bracket mount by interfitting with at least one mount aperture, the bracket defining first and second bracket apertures;

a first mesh shelf, the first mesh shelf carried by the bracket, the first mesh shelf including a first crossbar residing proximate to the bracket mount; and a mesh shelf locking clamp, the mesh shelf locking clamp including first and second convexities, the first convexity disposed in the first bracket aperture and the second convexity disposed in the second bracket aperture, the first and second convexities defining between them an axis of rotation;

the mesh shelf locking clamp being rotatable about the axis of rotation between a first position away from the first crossbar and a second position in which the mesh shelf locking clamp resides proximate to a portion of the first crossbar; and the mesh shelf locking clamp being attachable to the bracket mount when in the second position.

9. The mesh shelf system of claim 8, in which the mesh shelf locking clamp is detachable from the bracket mount.

10. The mesh shelf system of claim 8, in which the bracket includes a slot that is located proximate to the bracket mount and the first crossbar resides in the slot.

11. The mesh shelf system of claim 8, in which the mesh shelf locking clamp includes an arm and the arm is inserted into a mount aperture.

12. The mesh shelf system of claim 8, in which the mesh shelf locking clamp includes first and second arms and the first and second arms are each insertable into separate mount apertures.

13. The mesh shelf system of claim 8, further including a second mesh shelf, the second mesh shelf being carried by the bracket, the second mesh shelf including a second crossbar residing proximate to the bracket mount, the first and second mesh shelves nested with each other, and the mesh shelf locking clamp in the second position resides proximate to a portion of the second crossbar.

* * * * *